US008056560B2

(12) United States Patent
Wilcox

(10) Patent No.: US 8,056,560 B2
(45) Date of Patent: Nov. 15, 2011

(54) UNIVERSAL DUST MASK/FILTER FOR ATV AND DIRT BIKE RIDERS, METHOD OF MAKING AND METHOD OF USING

(76) Inventor: Timothy Andrew Wilcox, Lawrenceville, GA (US)

( * ) Notice: Subject to any disclaimer, the term of this patent is extended or adjusted under 35 U.S.C. 154(b) by 813 days.

(21) Appl. No.: 12/151,347

(22) Filed: May 6, 2008

(65) Prior Publication Data

US 2008/0283063 A1 Nov. 20, 2008

Related U.S. Application Data

(60) Provisional application No. 60/928,849, filed on May 14, 2007.

(51) Int. Cl.
*A62B 7/10* (2006.01)
*A62B 18/02* (2006.01)
*A62B 23/02* (2006.01)

(52) U.S. Cl. ..... 128/206.19; 128/206.12; 128/205.29

(58) Field of Classification Search ..... 128/201.25, 128/205.27, 5.29, 206.12, 206.19, 206.21, 128/206.27, 206.282
See application file for complete search history.

(56) References Cited

U.S. PATENT DOCUMENTS

| | | | | | |
|---|---|---|---|---|---|
| 2,201,315 | A | * | 5/1940 | Lehmberg | 128/206.16 |
| 2,634,725 | A | * | 4/1953 | Lo Presti | 128/206.19 |
| 3,521,630 | A | * | 7/1970 | Westberg et al. | 128/206.15 |
| 4,520,509 | A | * | 6/1985 | Ward | 2/206 |
| 4,883,052 | A | * | 11/1989 | Weiss et al. | 128/205.27 |
| 5,245,994 | A | * | 9/1993 | Chang et al. | 128/201.25 |
| 5,419,318 | A | * | 5/1995 | Tayebi | 128/205.27 |
| 5,641,555 | A | * | 6/1997 | Berrigan et al. | 428/152 |
| 5,717,991 | A | * | 2/1998 | Nozaki et al. | 2/9 |
| 5,727,544 | A | * | 3/1998 | Miura | 128/201.13 |
| 5,758,639 | A | * | 6/1998 | Ikonen | 128/201.25 |
| 7,036,507 | B2 | * | 5/2006 | Jensen | 128/206.19 |
| 7,086,400 | B2 | * | 8/2006 | Shigematsu et al. | 128/205.25 |
| 7,171,967 | B2 | * | 2/2007 | Brunell et al. | 128/206.19 |
| 7,185,653 | B2 | * | 3/2007 | Lee | 128/206.19 |
| 7,197,774 | B2 | * | 4/2007 | Curran et al. | 2/441 |
| 2003/0106557 | A1 | * | 6/2003 | Viljanen et al. | 128/206.21 |
| 2008/0006268 | A1 | * | 1/2008 | Hanlon | 128/201.25 |

FOREIGN PATENT DOCUMENTS

| | | | | |
|---|---|---|---|---|
| GB | 2025773 | A | * | 1/1980 |
| JP | 2005160499 | A | * | 6/2005 |

* cited by examiner

*Primary Examiner* — Loan Thanh
*Assistant Examiner* — Kathryn D Sheikh

(57) ABSTRACT

A face/dust mask constructed from differently-shaped filter media parts, each part having a different function, and each part interconnected so as to form a fitted air filter. Dual filters assist in eliminating from the intake air a substantial amount of the dust and debris encountered by riders of dirt bikes, manual bicycles, All-Terrain Vehicles, and other machines operated over unimproved, dusty terrain. By the nature of the materials and contours of the component parts, the mask fits comfortably and effectively for both adult and child users. The invention is highly resilient so as to adapt itself to the interior shape of a protective helmet or the mouthpiece section of a motorcycle helmet or similar safety helmet which is placed into position over the mask. The mask is of versatile design so as to enable a variety of embodiments with different filtering capabilities.

5 Claims, 7 Drawing Sheets

UNIVERSAL DUST MASK/FILTER FOR ATV AND DIRT BIKE RIDERS, METHOD OF MAKING AND METHOD OF USING

CROSS-REFERENCES TO RELATED APPLICATIONS

| U.S. Patent Documents | | | |
|---|---|---|---|
| 2,201,315 | 128/146 | 21 May 1940 | Lehmberg, W. |
| 3,521,630 | 128/146.6 | 28 Jul. 1970 | Westberg, W., et al. |
| 4,883,052 | 128/205.27 | 28 Nov. 1989 | Weiss, A. |
| 5,245,994 | 128/201.25 | 21 Sep. 1993 | Chang, L., et al. |
| 5,641,555 | 428/152 | 24 Jun. 1997 | Berrigan, M. et al. |
| 5,758,639 | 128/201.25 | 02 Jun. 1998 | Ikonen, A. |
| 7,036,507 | 128/206.19 | 02 May 2006 | Jensen, J. |
| 7,086,400 | 128/205.25 | 08 Aug. 2006 | Shigematsu, et al. |
| 7,171,967 | 128/206.19 | 06 Feb. 2007 | Brunell, R. |
| 7,185,653 | 128/206.19 | 06 Mar. 2007 | Lee, S. |
| 7,197,774 | 2/441 | 03 Apr. 2007 | Curran, D. et al. |

| Foreign Patent Documents | | | |
|---|---|---|---|
| JP2005160499 | A62B18/02 | 23 Jun. 2005 | Kohei, K., et al. |
| GB2025773A | A62B18/02 | 30 Jan. 1980 | White, W. |

| U.S. Patent Application Publication | | | |
|---|---|---|---|
| US2008/0006268 | 128/201.25 | 10 Jan. 2008 | Hanlon, D. |

RELATED U.S. APPLICATION DATA

This application claims the benefit of provisional application No. 60/928,849 filed on May 14, 2007.

STATEMENT REGARDING FEDERALLY SPONSORED RESEARCH

There is no federally sponsored research or development in connection with this invention.

PARTIES TO A JOINT RESEARCH AGREEMENT

There is no involvement in a joint research agreement with respect to this invention.

BACKGROUND OF THE INVENTION (1) Field of the Invention

This invention relates to a face mask which is particularly adapted for use by motorbike riders, drivers of All-Terrain-Vehicles and operators of other equipment driven over dusty, un-improved terrain.

Various face protectors and face masks have been invented over the years for different purposes and applications. For example, respiratory system masks are used in medical or hospital environments. Gas masks were developed over a century ago to give some degree of safety to military personnel who might potentially be exposed to chemical or toxic gasses in combat zones. Self-Contained Underwater Breathing Apparatus (SCUBA) is equipped with a specially designed watertight mask by means of which the wearer can breathe compressed air from a tank while maneuvering under water. Military fighter pilots are required to wear pressure-sealed masks connected to supplies of compressed oxygen, which is normally mixed with ambient air when the pilot inhales through the mask.

Carpenters and painters routinely use rather tight-fitting, uncomfortable masks to provide some degree of filtration during work involving sanding of wood or gypsum board building materials. These types of masks, however, clog easily. Further, they do not effectively permit the escape of exhaled air.

An important key to the effective use of the majority of masks is to ensure a tight seal around the perimeter of the mask as it presses against the wearer's face. For improving sealing characteristics the mask material in contact with the face is usually composed of a flexible material such as rubber, polyvinyl, or plastic compounds. A flexible or elastic material also allows for a fairly tight seal by persons of differing facial contours who may have occasion to use the same mask in an emergency situation.

Many mask designs also utilize various means of attaching the mask to the wearer's face, such as straps extending from each side of the mask, past the ears of the user, and fastening in some manner around the back of the wearer's head. A full face mask may also include a set of goggles or an integral visor, and fit over the entire head of the user. The present inventive concept is fabricated from materials, particularly open cell foam and filter media which have resilient qualities, permitting the mask to fit to the contour of a motorcycle helmet and snugly fit against the wearer's face without the use of straps or other attachment means.

(2) Description of the Related Art

An important feature of masks of the type disclosed in this invention is the inclusion of a filtration media to separate or cleanse harmful particles or contaminants from the ambient air as the air is inhaled by the wearer. One of the earlier generation of masks, featured in U.S. Pat. No. 2,201,315, was a compact respirator which contained a filter within the walls of the mask. The filter was interposed between two expandable walls of the mask and the mask body and the entire assembly fits over the mouth and the nose of the wearer.

U.S. Pat. No. 3,521,630 discloses a lightweight, disposable respirator face mask for filtering toxic dusts and mists. The filter material is a non-woven fibrous padding adhesively attached to a soft rubber sealing band which, in turn, fits against the face.

A protective breathing mask in U.S. Pat. No. 4,883,052 is designed to cover the mouth and nose of the wearer. The mask filter is composed of multiple layers of material; an outer layer, an inner layer, and between these two layers, a filter element comprising a particle filter and an adsorber filter. The adsorber material may be of electret material or any one of a variety of metallic compounds proven to be suitable for catalytically decomposing a wide range of noxious substances.

U.S. Pat. No. 5,758,639 is a combination of a helmet, a protective mask, and a respirator, designed to be worn by motorbike riders. The respirator, which functions most effectively when ram air is forced into it, comprises an inhalation valve and selected filter material. The respirator, as a whole, is made an integral part of the helmet. Also featured is an adjusting lever to reposition the respirator so as to enhance air flow under circumstances where the motorbike is stopped in traffic or for other purposes.

Disclosed in U.S. Pat. No. 7,086,400 is a mask consisting of a main body and face seal which are bonded together. The face seal is composed of a soft resin (such as polyurethane resin) which is laminated onto a surface consisting of an elastic fabric made of nylon or polyester fibers. The contour of the mask is variably shaped by a flexible frame, thereby allowing the mask to fit snugly against the wearer's face. The mask is held in place by a flexible cord on each side, which cords fit around the ears of the user.

A supplied air helmet is disclosed in U.S. Pat. No. 7,197,774. Air flow is initiated or enhanced by the action of differential pressures created by the use of filter-type materials of different permeabilities. The most effective air flow sections of the helmet are measured in order to attach the most effective materials at different pre-determined "zones" of the helmet's structure. Due to the different elasticities of the varied materials, pressure drops are generated in the appropriate zone or zones, thereby contributing to a supplied air flow.

U.S. Patent Application Publication No. US2008/0006268 discloses a protective helmet for motorbike riders. The invention includes one or more removable filters placed behind air intake ports, the said ports built into the helmet. Each filter is further coated with a benign adsorption fluid, such as vegetable oil, which helps capture dust particles, yet does not clog the pores of the filter.

BRIEF SUMMARY OF THE INVENTION

The present invention addresses the need to provide filtration of air inhaled by riders of all types of vehicles which are operated in dusty environmental conditions, "off-road," or over dirt roads utilized for competitive racing events. Under these circumstances, conditions are generated where quantities of dust and/or debris may be inhaled through the mouth or nostrils if the rider's mouth and nose are exposed.

This inventive concept is a face/dust mask constructed from differently-shaped filter media parts. Each part has a different function, and each part is adhesively interconnected so as to form a fitted air filter which, by the nature of the materials and contours of the component parts, fit easily over the nose and mouth of the user. The mask is flexible and resilient so as to adapt itself to the interior shape of a protective helmet or the mouthpiece section of a safety helmet into which the mask is inserted.

The mask is capable of filtering a substantial amount of the dust and debris encountered by riders of dirt bikes, All-Terrain Vehicles, and other machines or recreational equipment which may be operated over unimproved, dusty terrain. Airflow around the mask, combined with differential permeability of the component parts, produces an efficient combination of deflection and filtration of the ambient air to be supplied to, and inhaled by the wearer. Due to the arrangement of the component parts, the predominance of the air flowing toward the mask is subjected to primary and secondary filtering action, making the mask very effective.

GLOSSARY OF PART NUMBERS OF COMPONENTS OF INVENTION

Figure 1:
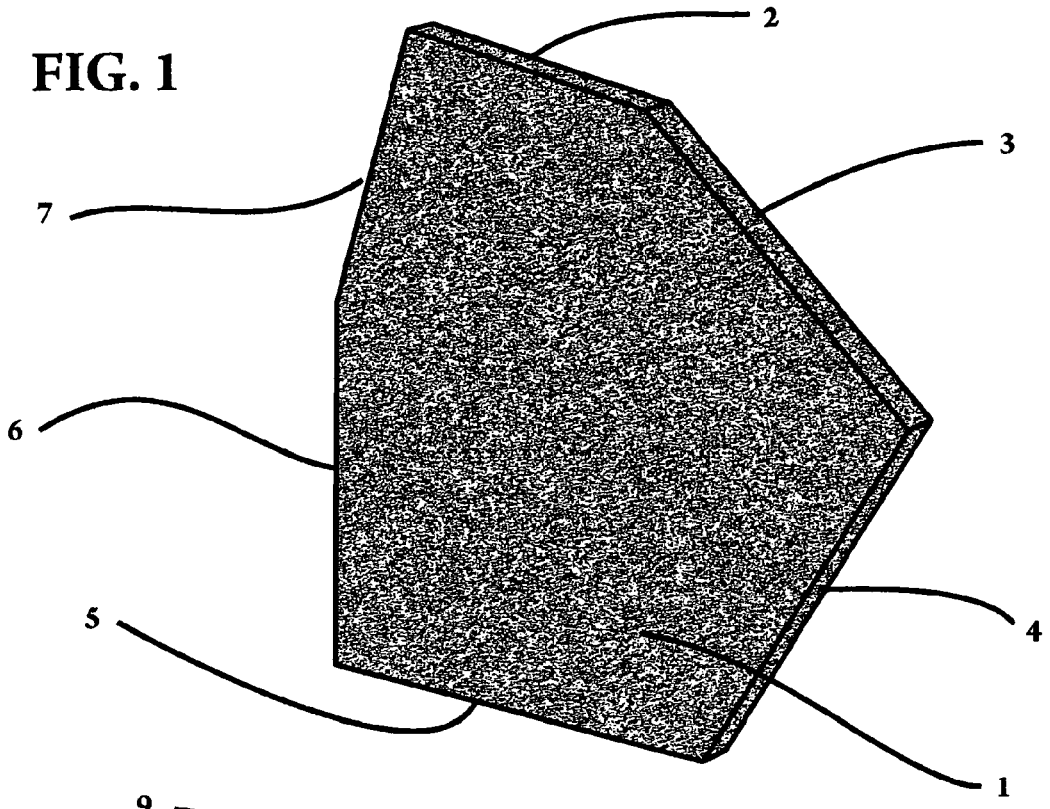
FIG. 1 depicts the left deflector 1 segment of the mask.

| | |
|---|---|
| 1. | Left deflector |
| 2. | Left nose bridge fitting |
| 3. | Left nose section edge |
| 4. | Left mouth section edge |
| 5. | Left chin section edge |
| 6. | Left lower jaw edge |
| 7. | Left mid-jaw edge |
| 8. | Right deflector |
| 9. | Right nose bridge fitting |
| 10. | Right nose section edge |
| 11. | Right mouth section edge |
| 12. | Right chin section edge |
| 13. | Right lower jaw edge |
| 14. | Right mid-jaw edge |
| 15. | Chin seam |
| 16. | Mouth seam |
| 17. | Nose Seam |
| 18. | Circle strut |
| 19. | Circle strut edge |
| 20. | Under-nose flap |
| 21. | Ovoid pad (or "faceplate") |
| 22. | Cutout from ovoid |
| 23. | Periphery of ovoid |
| 24. | Axis of symmetry of ovoid |
| 25. | Cord attachment |
| 26. | Fastening mechanism |
| 27. | Structural Seam |

DETAILED DESCRIPTION OF THE INVENTION

The main objective of the invention is to remove or deflect a substantial quantity of the dirt and debris from the air inhaled by a rider operating a dirt bike, all-terrain vehicle (ATV), or other machine under dusty ambient conditions. This is a universal need that is particularly applicable to riders of many common recreational vehicles and dirt bikes ridden competitively over dirt courses or off-road situations. Under dusty conditions it is difficult for the vehicle rider to breathe without some type of mask and/or a mouth or nose covering.

As stated earlier, this invention is fabricated from materials, particularly open cell foam and filter media, which have resilient qualities, permitting the mask to fit to the contour of a motorcycle helmet and snugly fit against the wearer's face without the use of straps or other attachment means.

Filter media is a mat of fibers that provide a barrier to particles entrained in the flow air, as is present in the air encountered by riders of vehicles operated on unimproved roads or in dusty environments. One of the important specifications to be considered when utilizing filter media is filter porosity. This characteristic is measured in ppi, or the average number of pores-per-linear-inch. The range of ppi provides an open cell material with little air restriction, to a fine-celled foam for maximum particulate filtration.

The vast majority of conventional dust masks generate uncomfortable heat around the wearer's nose and mouth area. Further, most of these masks do not permit a rapid enough rate of escape of exhaled air so as to ensure a dirt bike rider an adequate supply of incoming filtered air. The funnel shape of the mask disclosed herein provides dual filtering in that the deflectors 1 and 8 serve as pre-filters prior to air flowing through the circle strut 18 and additional air flowing through the ovoid 21 face pad.

The mask deflectors 1 and 8, the circle strut 18, and the under-nose flap 20 are constructed of open cell foam with a ppi rating in the range of 20 to 40 ppi. In contrast, the ovoid 21 face pad is constructed with open cell foam with a ppi rating in the range of 60 to 110 ppi, providing highly effective filtration. Experience has shown that airborne dust is most likely to enter the mask just prior to the area where the circle strut 18 is attached 28 to the deflectors 1, 8, thus the circle strut 18 performs a key filtration function at its junction with the deflectors 1 and 8.

The present invention does not use straps, since straps have been found to be uncomfortable under helmets typically worn by dirt bike riders. Further, straps are cumbersome in that they frequently get tangled in the rider's hair as the helmet is placed on the head or as the helmet is removed after a ride.

The open-cell foam materials used in this inventive concept allows some degree of cooling when worn against a rider's face. Open-cell foam is one of many categories of filter media in widespread use in various industrial and consumer product applications. Included among the types of open-cell foam are polyester, polyether polyurethane, low permeability, polymide, and melamine. Open-cell foams can be worked with heat and other processes so as render the material very soft and pliable, or into a relatively stiff consistency, or into a board-like rigidity.

The inventive concept presented herein works by using five pieces of open cell filter foam assembled together to form a funnel-shaped apparatus. The open-cell foam utilized has inherently resilient qualities, making the mask comfortable against the rider's face and also allowing the mask to assume the relative contour of the helmet faceguard. The completely assembled mask is inserted into the face guard area of the helmet as the helmet is placed onto the head of the rider. For the remainder of its use during the ride, the mask is held in place by the firm contact of the helmet pressing the mask against the rider's face. Further, as the open-cell material of the mask naturally attempts to return to its original shape, it provides a degree of sealing around the perimeter of the mask.

Figure 2:
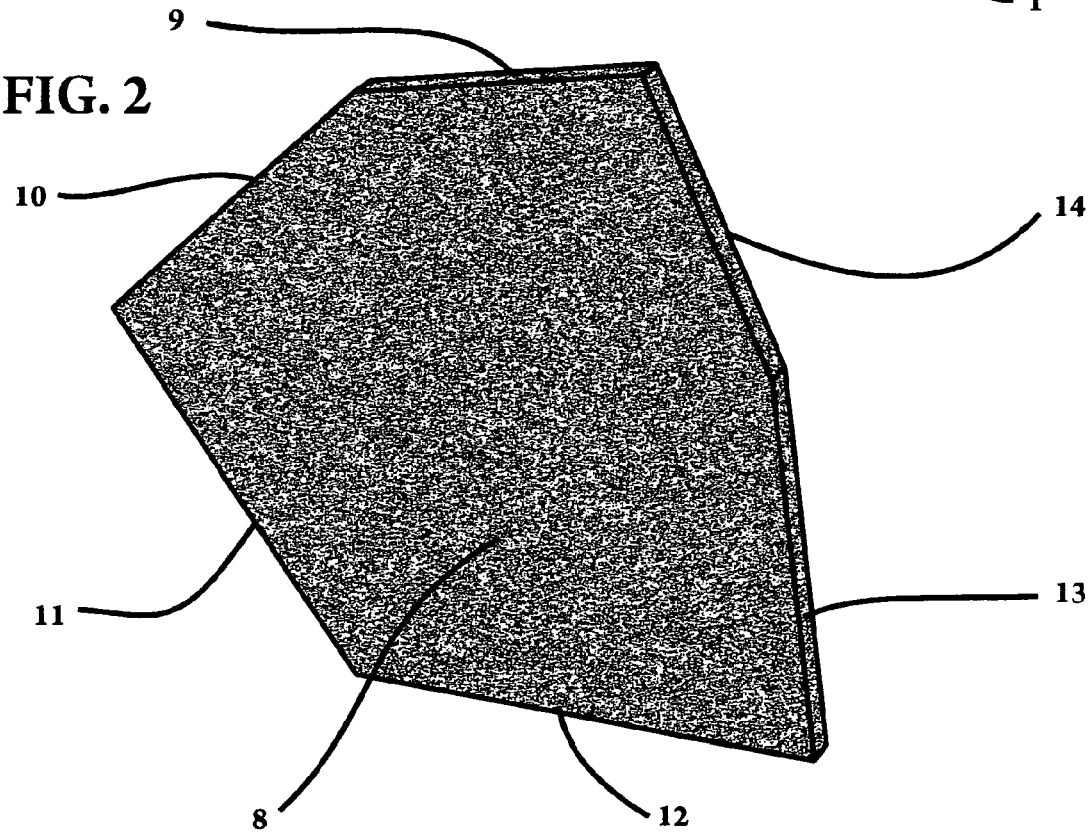
FIG. 2 is the corresponding right deflector 8 segment of the mask.

In viewing FIG. 1 and FIG. 2, the largest pieces and principal functioning components of the mask, referred to as the left deflector 1 and right deflector 8, respectively, are shown. The "inside" surfaces of the two deflectors are shown in both FIG. 1 and FIG. 2, the surfaces being oriented relative to how the deflectors would be positioned against the left side and the right side, respectively, of a wearer's face. The left deflector 1 and right deflector 8 function not only as filter media while the mask is worn, but also operate to deflect the airflow into a slipstream, thus preventing the direct perpendicular impact of airborne dust particles against the exterior surfaces of the deflectors.

The next step in the assembly process is to join or bond the two deflectors 1 and 8 along three corresponding edges of each deflector. The left nose section edge 3 will be bonded to the right nose section edge 10; the left mouth section edge 4 will be bonded to the right mouth section edge 11; and the left chin section edge 5 will be bonded to the right chin section edge 12. The aforementioned bonds are accomplished using polyamide hot melt adhesive, or commonly called "hot melt glue."

Figure 5:
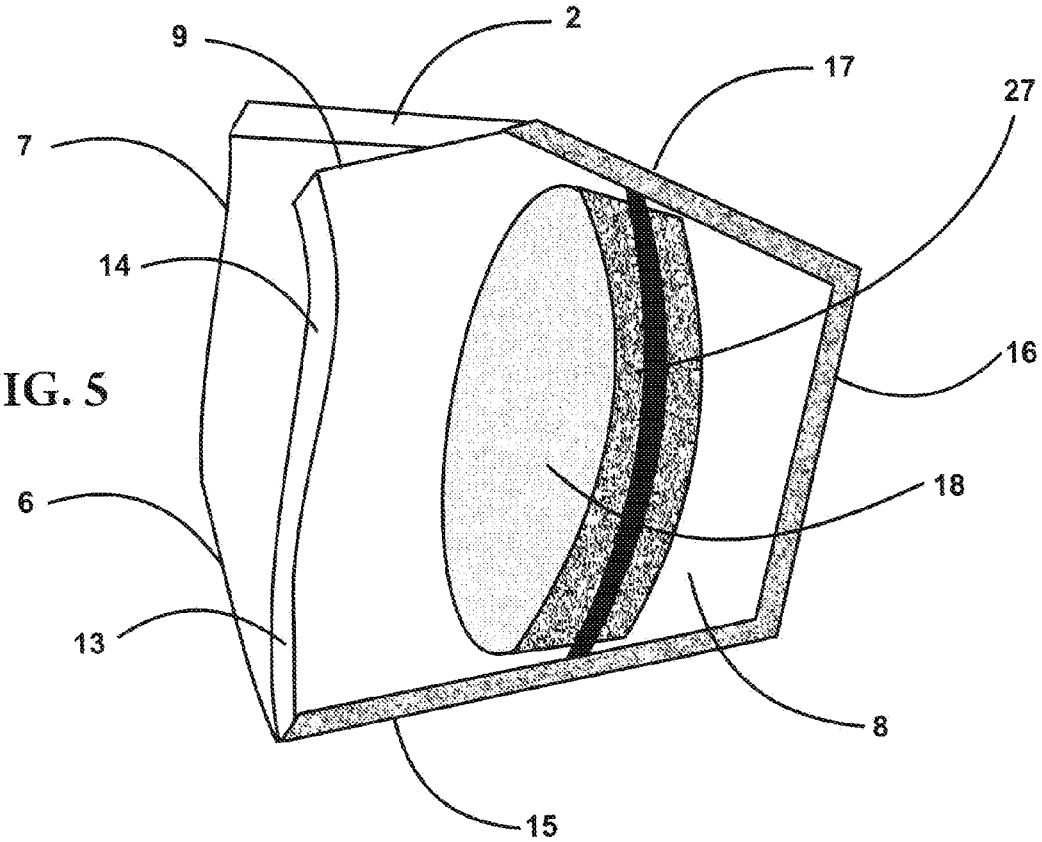
FIG. 5 is a see-through view depicting an intermediate stage of assembly of the mask, showing the two deflectors, 1 and 8, assembled around the circumference of the circle strut 18 member.
Figure 6:
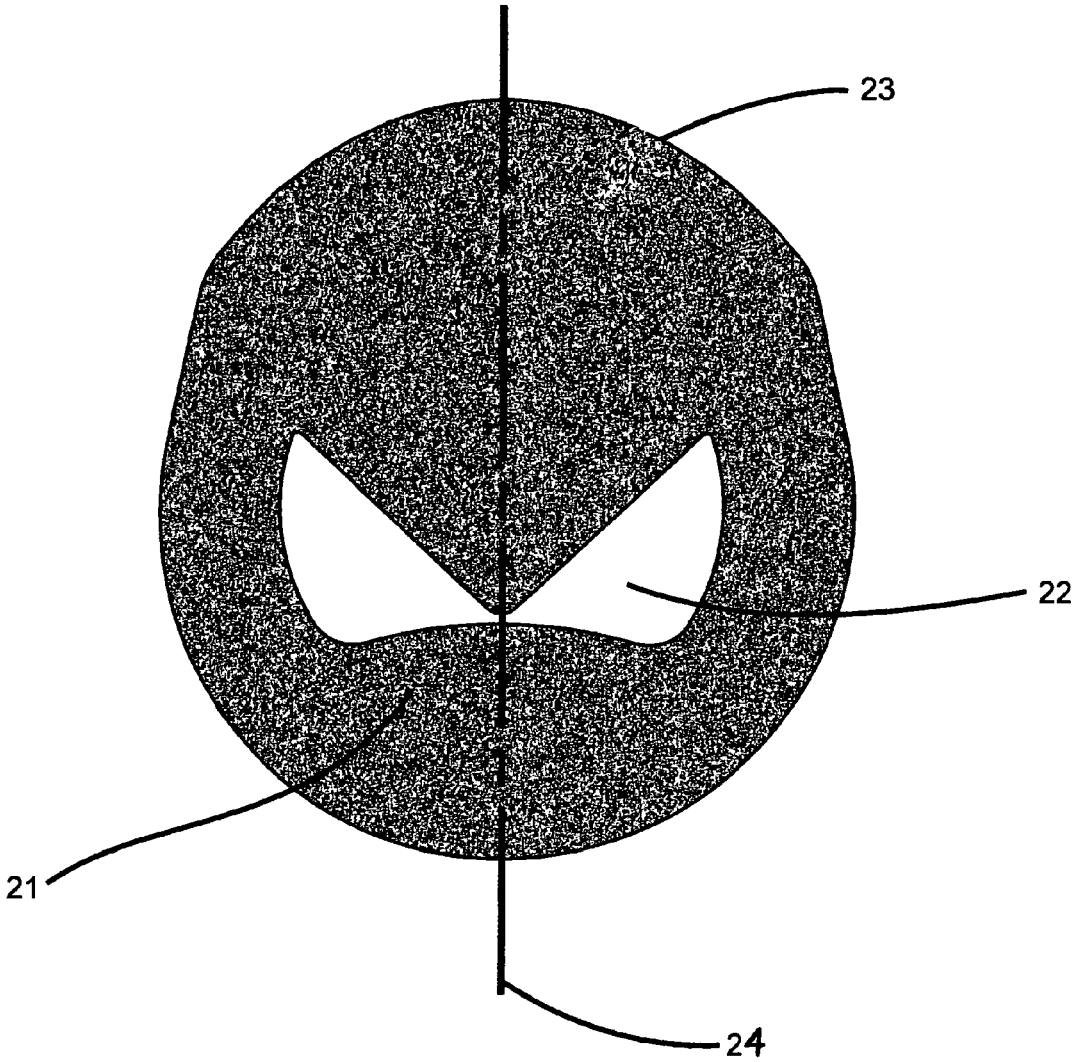
FIG. 6 presents a view, looking in a perpendicular orientation to the ovoid 21 face piece, with the cutout portion 22 having been excised.

After these three bonds are completed, we must jump to FIG. 5 to further clarify the three seams: the chin seam 15, the mouth seam 16, and the nose seam 17 which are thus formed. The three seams 15, 16, and 17 serve to enhance the rigidity of the mask when it is ultimately assembled into one unit. The remaining un-bonded edges of the two deflectors, namely the left lower jaw edge 6, left mid-jaw seam 7, right lower jaw edge 13, and the right mid-jaw edge 14 serve specifically to adhesively abut the ovoid 21 faceplate (FIG. 6) which said ovoid 21 faceplate itself is in direct contact with the wearer's face as the mask is worn. The left lower jaw edge 6, left mid-jaw edge 7, right lower jaw edge 13, and right mid-jaw edge 14 each functions by pressing the ovoid 21 faceplate onto those respective parts of the wearer's face while the mask is worn inside a helmet. Likewise, the left nose bridge fitting 2 and the right nose bridge fitting 9 fit against those respective parts of the wearer's face.

Figure 3:
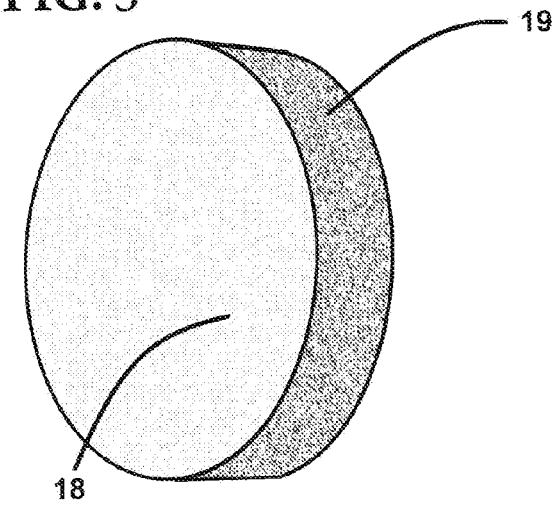
FIG. 3 is a circle strut 18 member, functioning to give rigidity to the assembled mask.
Figure 4:
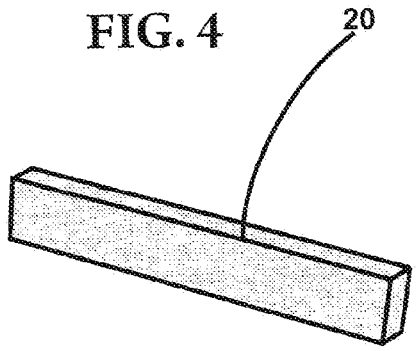
FIG. 4 is a right rectangular prism 20 segment of filter media which serves to bond and connect the left and right deflectors.

Turning the attention to FIG. 3, a "circle strut" 18 device is shown. The said circle strut 18 is composed of a denser, more rigid grade of open-cell foam. Referring again to FIG. 5, the see-through view of the sub-assembly of the mask, one can observe that the circle strut 18 has been inserted into the opening between the conjoined left deflector 1 and right deflector 8. As a result, the circle strut 18 serves to lend both rigidity and a funnel shape to the mask assembly. The funnel shape helps to provide a comfortable fit for the wearer's face, and a more resilient contour that is readily adaptable to the shape of the mouthpiece section of the wearer's helmet.

Referring again to FIG. 6, there is illustrated another component of the invention, a relatively soft and resilient type of filter media cut and shaped into an ovoid 21. The ovoid 21 is designed to function as a faceplate, and is fabricated with a "cutout" 22, said cutout designed so as to allow space for the flow of inhaled air into the mask wearer's nose and/or mouth. The mask sub-assembly shown in FIG. 5, composed of the conjoined left deflector 1 and right deflector 8, is then attached to the ovoid 21 faceplate. Edges 6, 7, 13, and 14 (as shown in FIG. 5) of the mask sub-assembly are adhesively attached around the periphery 23 of the ovoid 21.

Figure 7:
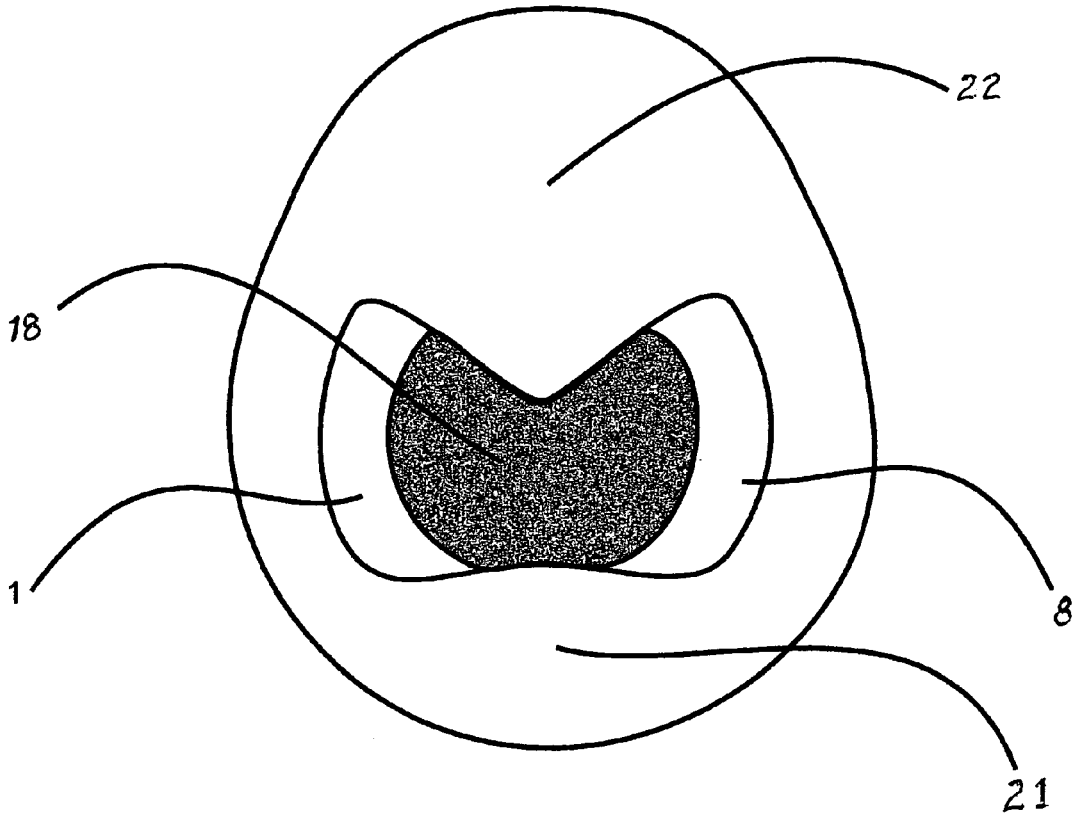
FIG. 7 shows a completely assembled dusk mask from the perspective of the wearer, just prior to placing an ovoid faceplate 21 over the mouth and nose.

At this point, the mask is almost fully assembled and FIG. 7 next depicts a view toward the interior of the mask, as if the wearer is grasping the mask and in the act of pressing the ovoid 21 faceplate against his/her face. The upper part of the ovoid 22 is bent upward into the position it would assume if pressed against a wearer's face. Portions of the interior surfaces of the left deflector 1 and the right deflector 8 are shown, as is the circle strut 18.

Figure 8:
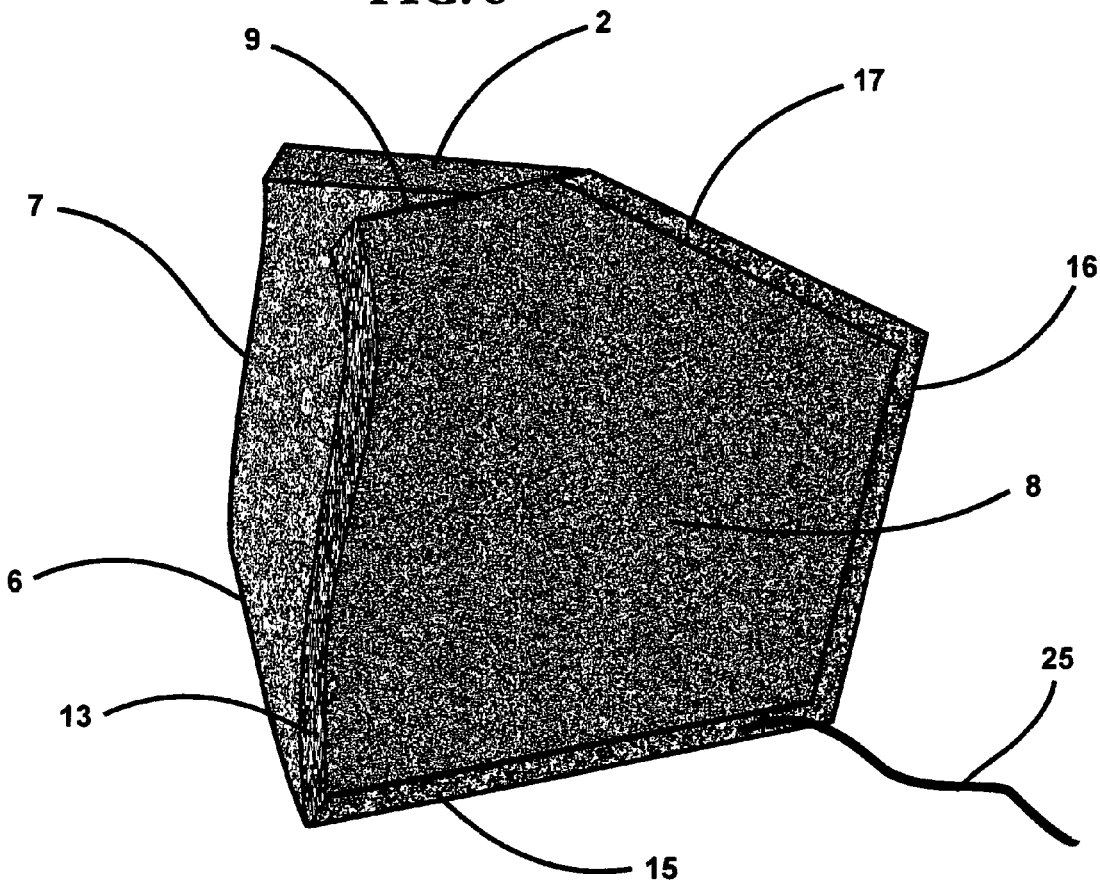
FIG. 8 depicts a side view of a partially assembled mask, with the left deflector 8 prominently shown, butted against the faceplate on the right edge of the figure.

FIG. 8 depicts the mask sub-assembly just prior to adhesively attaching the mask edges, 6, 7, 13, and 14, to the ovoid faceplate 21.

Figure 9:
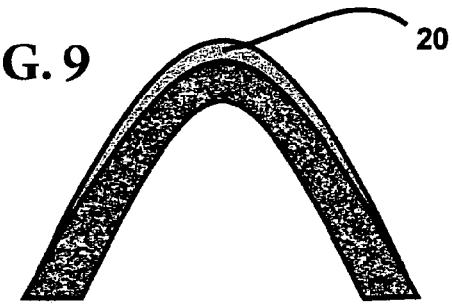
FIG. 9 depicts the under-nose flap 20 of the mask, bent into the shape it will assume when attached to the mask.

FIG. 9 depicts the under-nose flap 20 as it is bent into the shape it will assume when attached to the mask in the vicinity of the left nose bridge fitting 2 and the right nose bridge fitting 9.

Figure 10:
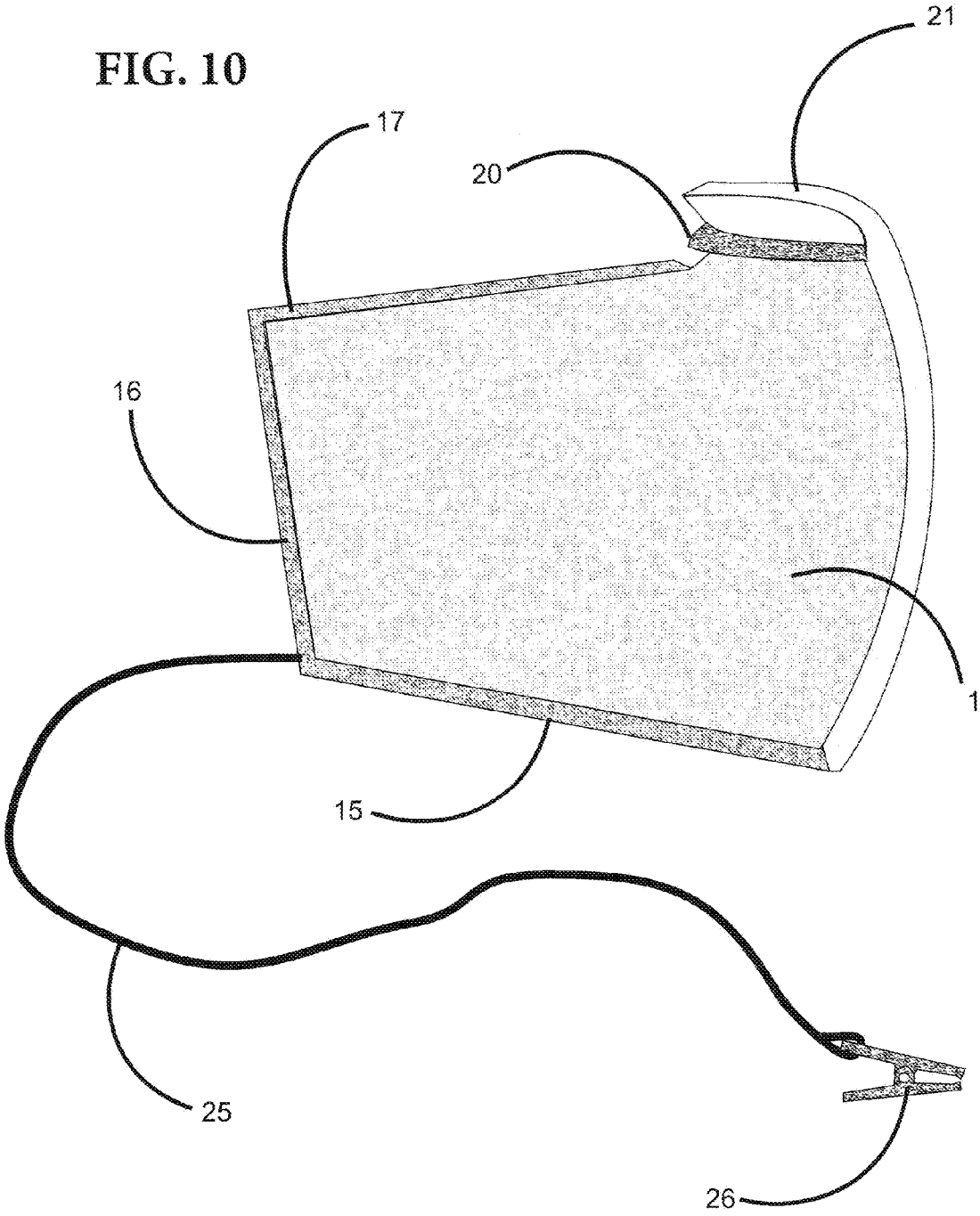
FIG. 10 is a side view of the completely assembled dust mask.

FIG. 10 presents a left-side view of the mask as fully assembled, with the left deflector 1 being the predominant feature. The last step of the mask assembly is the attachment of the under-nose flap 20 to the left nose bridge fitting 2 and the right nose bridge fitting 9 (out of view). The ovoid 21 faceplate is noticeably bent forward, but is not attached to the under-nose flap 20, thereby allowing the under-nose flap 20 to function as a pre-filter just below the wearer's nostrils. For children and smaller riders, the under-nose flap 20 may be positioned directly over the nose.

Figure 11:
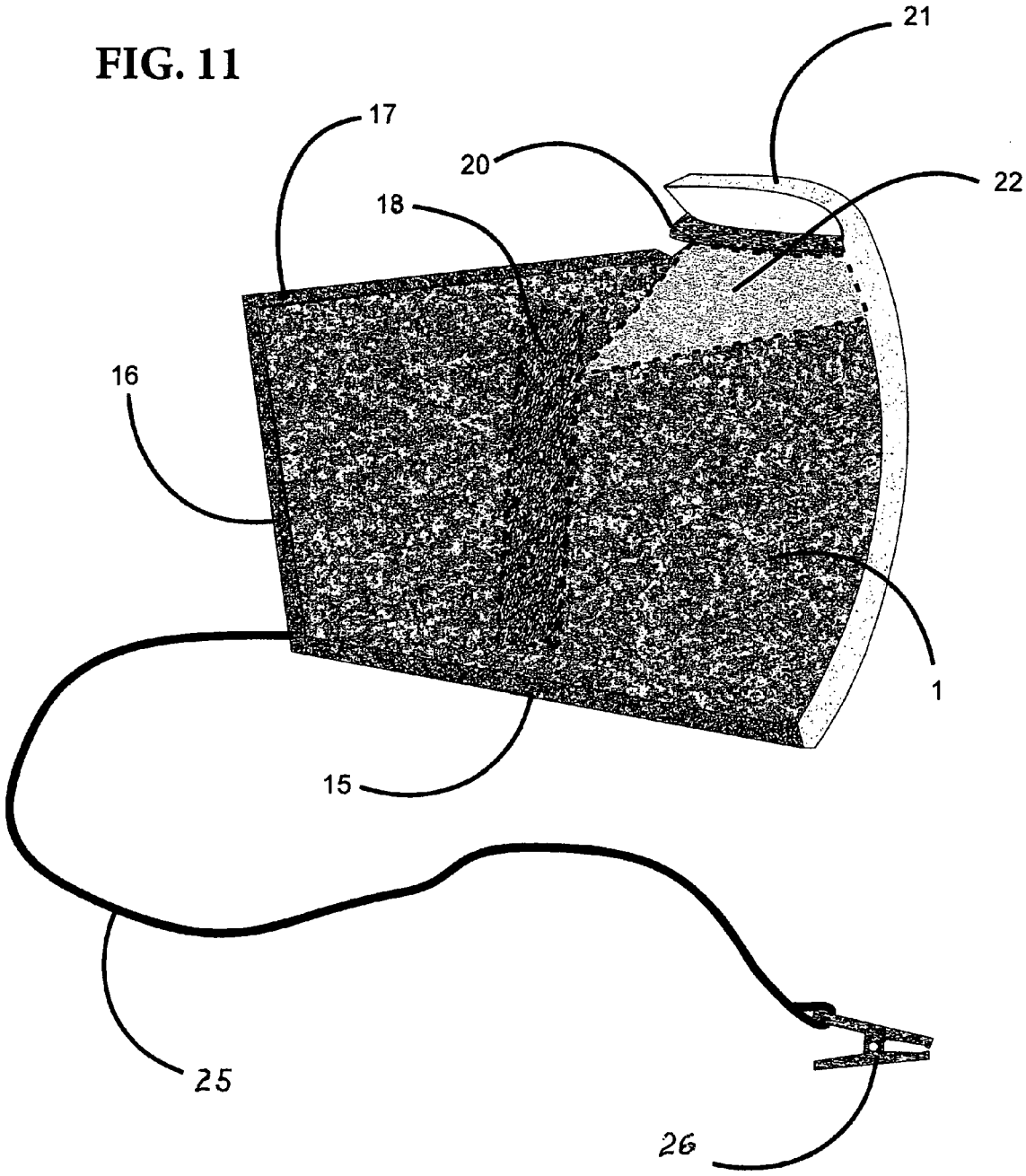
FIG. 11 is also a side view with a partial "see-through" section.

The general nose bridge area of the mask also helps provide a contoured fit to the mask wearer's face which, in turn, forms a snug seal for the mask. The under-nose flap 20 is positioned on the two nose bridge fittings 2 and 9, in order to prevent the mask from interfering with the sealing of a wearer's goggles and to prevent excess pressure on the wearer's nose. The positioning of the under-nose flap 20 is also illustrated in FIG. 11. FIG. 11 further illustrates, in a see-through view, the top portion of the ovoid 21 face plate as it is inclined forward toward the circle strut 18 due to slight pressure from the wearer's upper lip.

For convenience of use, the mask may be attached to an article of clothing of the wearer by use of a fastening mechanism 26 at the end of a cord 25 of appropriate length, which cord 25 is permanently affixed to the mask.

Donning of the self-sealing dust/filter mask comprises the steps of a) bending the top of the ovoid pad slightly forward; and
b) placing the upper part of the cutout of the ovoid against the upper lip; and
c) physically perceiving that the noseband presses the top portion of the ovoid pad to a position slightly below the user's nostrils; and
d) bending the intersection of the nose seam and mouth seam toward the user's right jaw and downward, while simultaneously bending the intersection of the mouth seam and the chin seam toward the user's left jaw and upward; and
e) holding slight pressure on the mask against the face; and
f) pulling the helmet down while holding the mask against the face; and
g) making minor adjustments to the seating of the ovoid pad so as to allow the under-nose flap to function as a pre-filter for nostril air intake;
h) making minor adjustments to the seating of the ovoid pad so as to allow the upper portion of the ovoid pad to function as the primary filter for nostril air intake; and
i) inhaling as deeply and as rapidly as necessary for the sake of convenience and/or physiological needs.

It should be noted that the seams in this inventive concept intersect at various points to add a degree of rigidity to the mask skeletal structure but that the overall effect of the open cell foam media is to form a flexible structure. In referring to FIG. 6, FIG. 7, and FIG. 10 it may be pointed out that the ovoid 21 face seal, and the under-nose flap 20 function as secondary filters, behind the left deflector land the right deflector 8. In reviewing FIG. 10, it is pointed out that the under-nose flap 20 functions as a pre-filter for the outward-bent portion of the ovoid 21 faceplate as it fits against, or just below an adult's nostrils. This portion of the ovoid 21 faceplate serves to fit over the nose of small children. In FIG. 7, the "V"-shaped segment of the ovoid 21 faceplate fits across the upper lip and under the nostrils of an adult wearer. The circle strut 18, in addition to adding structural integrity, also functions as a secondary filter of the air that penetrates the lower portions of the deflectors, 1 and 8. A method of manufacture of the dust/filter mask comprises the steps of (a) cutting two pads of material comprising polyurethane open-cell material, each pad of thickness in the range of 0.2 inch to 0.8 inch and planar dimensions in the range of 3.0 inches by 5.0 inches, into matching, irregularly-sided hexagonal pads, coating each pad with a thin layer of silicone; and
(b) fashioning an appropriately-sized piece of flexible polyester polyurethane filter material, of a thickness in the range of 0.15 inch to 0.40 inch, into an ovoid-shaped pad with only one symmetrical axis (oriented vertically), the said axis being in the range of 4.0 inches to 5.0 inches in height, and the horizontal dimension of the ovoid at its widest, being in the range of 2.8 to 3.5 inches in width, the said pad further containing a center cutout section, the said cutout resembling spread butterfly wings, the "spread" of the wings oriented so as to be symmetrical about the symmetrical axis of the ovoid; and
(c) cutting a circular circle strut from coarse, low permeability foam, said circle strut of a diameter in the range of 1.5 inches to 2.5 inches and of a thickness in the range of 0.25 to 0.75 inch, said circle strut functioning as a "filtration strut;" and
(d) fashioning a right rectangular prism of polyurethane material of a thickness between 0.10 inch to 0.40 inch, width between a range of 0.20 inch to 0.50 inch, and length within a range of 1.5 inches to 3.5 inches, said strip to function as an "under-nose flap;" and
(e) drawing specific guidelines upon each hexagonal-shaped pad, said guidelines more precisely forming the desired sides, dimensions, and angles of an irregularly-sided hexagonal plane upon each hexagonal pad; and
(f) applying "hot melt" glue, said glue possessing a heat tolerance in the range of 180° F. to 280° F., in approximately 0.25 inch-wide layers, onto three corresponding sides of each hexagonal plane; and
(g) conjoining the said three corresponding sides of each hexagonal plane and simultaneously applying moderate pressure along said conjoined sides so as to ensure continuous adhesive contact along the three seams thus formed; and
(h) subsequent to allowing cooling time for the glued seams, precisely cutting the three seams into more precisely-shaped edges; and
(i) applying a quantity of the said "hot melt" glue onto the circumferential edge of the circle strut and inserting said circle strut halfway into the depth of the funnel formed by gently squeezing the conjoined hexagonal pads together, and
(j) applying a quantity of the said "hot melt" glue, in an approximately 0.50-inch wide layer, around three-quarters of the periphery of the ovoid-shaped pad, plane, leaving a dry unglued one-quarter peripheral segment on each side of the upper segment of the symmetrical axis of the ovoid pad; and
(k) pressing the glue-saturated segment of the ovoid-shaped pad onto the two corresponding, consecutive edges at the base of the funnel formed by the insertion of the circle strut; and
(l) applying a quantity of "hot melt" glue onto each endmost one-third segments of the "under-nose" flap; and
m) thereafter attaching, with moderate pressure, each end of the under-nose flap to the respective edges of each hexagonal piece at the point where the hexagonal pieces join to form the nose seam.

It must be noted that the inventive concept may be built in different embodiments by (1) customizing the various porosities of filter media components to suit the rider's needs, and/or (2) inserting supplemental filter media along the inner periphery of the deflectors, 1 and 8, or the circle strut 18, thereby providing greater dual filtering capacity.

The circle strut 18 may be composed of filter media with an acceptable porosity range of 15 to 45 ppi. The cutout 22 section of the ovoid 21 pad may vary from a relatively larger size to function more as a secondary filter, or to a relatively smaller size in order to allow more airflow from the circle strut 18. The acceptable porosity range of the ovoid 21 pad may vary from 60 to 110 ppi. The porosity range of the under-nose flap 20 may vary from 20 to 80 ppi, depending the airflow and filterability desired.

Alterations or modifications to the various materials and methods disclosed in this invention will be apparent to persons skilled in the art, and such alterations or modifications will not deviate from the intent and overall function of this inventive concept. The scope of this invention therefore should not be restricted to the explanations, means, and other information set forth herein for illustrative and explanatory purposes.

What is claimed is:

1. A dust filtering mask for adaptably fitting into the inner confines of a motorcycle helmet or similar protective head gear, said helmet or protective headgear worn by the operator of a dirt bike, all-terrain-vehicle, or other equipment used to function over un-improved roads or dusty terrain, comprising:

two identical polygonally-shaped segments of filter media with at least four sides each, wherein said segments are joined together along three corresponding sides of each segment to form three consecutive seams, comprising a nose seam, a mouth seam, and a chin seam, wherein applying slight inward pressure to the seams of the conjoined polygonally-shaped segments-creates a hollow conical shape with an open end and an opposite closed end, wherein said open end and said closed end define an axis through the mask; and a disc composed of filter material, wherein said disc is inserted into said conical shape perpendicularly to said axis, further wherein the entire circumferential edge of said disc is adhesively fixed to the inner surfaces of the polygonally-shaped segments, resulting in permanence of the conical opening; and a pad composed of filter media fashioned into an ovoid shape, said ovoid-shaped pad further containing a center cutout section; and the open end of the conical shape formed by the polygonally-shaped segments is adhesively attached to a substantial portion of the perimeter of said ovoid pad; and a right rectangular prism comprised of filter media, wherein said prism is adhesively attached to each corresponding edge of the two polygonally-shaped segments near the junction of the two edges of the polygonally-shaped segments with the nose seam.

2. A dust filtering mask constructed to adaptably fit into the inner confines of a motorcycle helmet or similar protective head gear, said helmet or protective headgear worn by the operator of a dirt bike, all-terrain-vehicle, or other equipment used to function over un-improved roads or dusty terrain, comprising:

two, identical irregularly-sided hexagonally-shaped segments of filter media of a thickness in the range of 0.20 in. to 0.8 in., wherein said segments are joined together along three corresponding sides of each segment by the application of glue and moderate pressure so as to form three consecutive laminated seams, comprising a nose seam, a mouth seam, and a chin seam, the width of each seam in the range of 0.2 in. to 0.8 in.; and a disc-shaped component composed of coarse filter media with a diameter in the range of 1.5 in. to 2.5 in. and a thickness in the range of 0.3 in. to 0.8 in., wherein glue is applied around the circumferential edge of said component, further wherein said component is inserted into the hollow conical shape created by the application of slight inward pressure to the seams of the two conjoined hexagonal segments, and thereby adhesively attaching said component onto the inner surfaces of the hexagonally-shaped segments; and a pad composed of soft filter media material of a thickness in the range of 0.2 in. to 0.8 in., fashioned into an ovoid shape, with one axis being longer than the other, thus constituting the ovoid's only axis of symmetry, which axis also defines a functional vertical orientation for the ovoid pad; and said ovoid pad further having a center cutout section, the center cutout resembling the contour of butterfly wings spread open in an orientation along the shorter axis of the ovoid pad; and wherein glue is applied to corresponding edges of the hexagonal-shaped segments which form the open end of the conical shape, said edges then being adhesively attached around the periphery of the of the ovoid pad, leaving a small portion of excess ovoid pad material at the upper end of the ovoid pad's axis of symmetry; and a right rectangular prism comprised of filter media, said prism having dimensions of width in the range of 0.2 in. to 0.5 in., by height in the range of 0.2 in. to 0.5 in., by length in the range of 1.5 in. to 2.5 in., wherein said right rectangular prism is adhesively attached to each corresponding edge of the two hexagonally-shaped segments near the junction of the two edges with the nose seam.

3. A dust filtering mask as in claim 2, further comprising a cord or string-like device adhesively attached to either of the hexagonally-shaped pads, said cord terminating with a means for clipping or fastening the cord and the adjoined dust mask to some portion of the clothing or personal equipment of the mask user.

4. A method for manufacturing a self-sealing dusk mask suitable for filtering the air inhaled by riders of dirt bikes, all-terrain vehicles, military equipment, or other types of wheeled or tracked machinery operated over unimproved dirt terrain, comprising the steps of (a) cutting two pads of material comprising polyurethane open-cell material, each pad of thickness in the range of 0.2 inch to 0.8 inch and planar dimensions in the range of 3.0 inches by 5.0 inches, into matching, irregularly-sided hexagonal pads, coating each pad with a thin layer of silicone; and (b) fashioning a piece of flexible polyester polyurethane filter material, of a thickness in the range of 0.15 in. to 0.40 in., into an ovoid- shaped pad with only one symmetrical axis, which is oriented vertically, said axis being in the range of 4.0 in. to 5.0 in. in height, and the horizontal dimension of the ovoid at its widest, being in the range of 2.8 in. to 3.5 in. in width, said ovoid pad further containing a center cutout section, said cutout resembling spread butterfly wings, the "spread" of the wings oriented so as to be symmetrical about the symmetrical axis of the ovoid; and (c) cutting a circle strut from coarse, low permeability foam, said circle strut of a diameter in the range of 1.5 in. to 2.5 in. and of a thickness in the range of 0.25 in. to 0.75 in., said circle strut functioning as a "filtration strut;" and (d) fashioning a right rectangular prism of polyurethane material of a thickness between 0.10 in. to 0.40 in., width between a range of 0.20 in. to 0.50 in., and length within a range of 1.5 in. to 3.5 in., said strip to function as an "under-nose flap;" and (e) drawing guidelines upon each hexagonal-shaped pad, said guidelines forming the sides, dimensions, and angles of an irregularly-sided hexagonal plane upon each hexagonal pad; and (f) applying "hot melt" glue, said glue possessing a heat tolerance in the range of 180° F.to 280° F., in approximately 0.25 inch-wide layers, onto three corresponding sides of each hexagonal plane; and (g) conjoining the said three corresponding sides of each hexagonal plane and simultaneously applying moderate pressure along said conjoined sides so as to ensure continuous adhesive contact along the three seams thus formed; and (h) subsequent to allowing cooling time for the glued seams, precisely cutting the three seams into more precisely-shaped edges; and (i) applying a quantity of the said "hot melt" glue onto the circumferential edge of said circle strut and inserting said circle strut halfway into the depth of the conical shape formed by gently squeezing the conjoined hexagonal pads together; and (j) applying a quantity of the said "hot melt" glue, in an approximately 0.50-inch wide layer, around three-quarters of the periphery of the ovoid-shaped pad, plane, leaving a dry unglued one eighth peripheral segment on each side of the upper segment of the symmetrical axis of the ovoid pad; and (k) pressing the glue-saturated segment of the ovoid-shaped pad onto the two corresponding, consecutive edges at the base of the conical shape formed by the insertion of the circle strut; and (l) applying a quantity of "hot melt" glue onto each end-most one-third segments of the "under-nose" flap; and (m) thereafter attaching, with moderate pressure, each end of the under-nose flap to the respective edges of each hexagonal piece at the point where the hexagonal pieces join to form the nose seam.

5. A method for providing effective filtering of air inhaled by helmeted riders of dirt bikes, all-terrain vehicles, competition pedal-powered bicycles, and other vehicles operated under dusty environmental conditions or over un-improved dirt terrain, by means of a user donning the self-sealing dust/filter mask as in claim 2, further comprising the steps of a) bending the top of the ovoid pad slightly forward; and b) placing the upper part of the cutout of the ovoid against the upper lip; and c) physically perceiving that the right rectangular prism, which functions as an under-nose flap, presses the top portion of the ovoid pad to a position slightly below the user's nostrils; and d) bending the intersection of the nose seam and mouth seam toward the user's right jaw and downward, while simultaneously bending the intersection of the mouth seam and the chin seam toward the user's left jaw and upward; and e) holding slight pressure on the mask against the face; and f) pulling the helmet down while holding the mask against the face; and g) making minor adjustments to the seating of the ovoid pad so as to allow the under-nose flap to function as a pre-filter for nostril air intake;

h) making minor adjustments to the seating of the ovoid pad so as to allow the upper portion of the ovoid pad to function as the primary filter for nostril air intake; and i) inhaling as deeply and as rapidly as necessary for the sake of convenience and/or physiological needs.

* * * * *